US010185249B2

(12) United States Patent
Matsumoto

(10) Patent No.: US 10,185,249 B2
(45) Date of Patent: Jan. 22, 2019

(54) DEVELOPING DEVICE WITH TONER CONTAINING A TONER PARTICLE AND A ZINC STEARATE PARTICLE, AND PROCESS CARTRIDGE, IMAGE FORMING APPARATUS, AND IMAGE FORMING METHOD

(71) Applicant: FUJI XEROX CO., LTD., Tokyo (JP)

(72) Inventor: Yasutaka Matsumoto, Kanagawa (JP)

(73) Assignee: FUJI XEROX CO., LTD., Minato-ku (JP)

( * ) Notice: Subject to any disclaimer, the term of this patent is extended or adjusted under 35 U.S.C. 154(b) by 0 days.

(21) Appl. No.: 15/251,613

(22) Filed: Aug. 30, 2016

(65) Prior Publication Data

US 2017/0277078 A1 Sep. 28, 2017

(30) Foreign Application Priority Data

Mar. 25, 2016 (JP) ..... 2016-062523

(51) Int. Cl.
*G03G 15/08* (2006.01)
*G03G 21/16* (2006.01)

(52) U.S. Cl.
CPC ..... *G03G 15/0891* (2013.01); *G03G 15/0893* (2013.01); *G03G 21/1676* (2013.01);
(Continued)

(58) Field of Classification Search
CPC ..... G03G 15/0891
(Continued)

(56) References Cited

U.S. PATENT DOCUMENTS

2011/0081177 A1* 4/2011 Nishida ..... G03G 21/00 399/346
2014/0349228 A1* 11/2014 Kadonome ..... G03G 9/0819 430/108.3

(Continued)

FOREIGN PATENT DOCUMENTS

JP 2007-094240 A 4/2007
JP 2015-014650 A 1/2015

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

A developing device includes a developer container that accommodates an electrostatic image developer including toner containing a toner particle and a zinc stearate particle, a ratio ($D_T/D_S$) of a volume-average particle size ($D_T$) of the toner particle to a volume-average particle size ($D_S$) of the zinc stearate particle being about 1.9 or more; a developer carrier that supplies the toner to an image carrier; a supply conveyor that supplies the electrostatic image developer while conveying the electrostatic image developer; a mixing conveyor that conveys the electrostatic image developer while mixing the electrostatic image developer; and a partition disposed between the supply conveyor and the mixing conveyor. The electrostatic image developer is moved from the supply conveyor to the mixing conveyor through a first passage and is moved from the mixing conveyor to the supply conveyor through a second passage.

10 Claims, 7 Drawing Sheets

(52) U.S. Cl.
CPC ..... *G03G 2215/0132* (2013.01); *G03G 2215/083* (2013.01); *G03G 2215/0833* (2013.01); *G03G 2215/0838* (2013.01); *G03G 2215/0844* (2013.01)

(58) Field of Classification Search
USPC ..... 399/119
See application file for complete search history.

(56) References Cited

U.S. PATENT DOCUMENTS

2015/0277245 A1* 10/2015 Kajiwara ..... G03G 5/047 430/58.2
2015/0323886 A1* 11/2015 Mandai ..... G03G 15/0891 399/254

* cited by examiner

DEVELOPING DEVICE WITH TONER CONTAINING A TONER PARTICLE AND A ZINC STEARATE PARTICLE, AND PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2016-062523 filed Mar. 25, 2016.

BACKGROUND (i) Technical Field

The present invention relates to a developing device, a process cartridge, an image forming apparatus, and an image forming method.

(ii) Related Art

Methods for forming visible images from image information using an electrostatic image, such as electrophotography, are currently being used in various fields. In electrophotography, an electrostatic image formed on a photosensitive member through a charging step and an electrostatic image forming step is developed with a developer containing toner, and a visible image is formed through a transferring step and a fixing step.

SUMMARY

According to an aspect of the invention, there is provided a developing device including a developer container that accommodates an electrostatic image developer including toner containing a toner particle and a zinc stearate particle externally added to the toner particle, a ratio ($D_T/D_S$) of a volume-average particle size ($D_T$) of the toner particle to a volume-average particle size ($D_S$) of the zinc stearate particle being about 1.9 or more; a developer carrier that has a surface on which the electrostatic image developer is carried and that supplies the toner to an image carrier; a supply conveyor that supplies the electrostatic image developer to the surface of the developer carrier while conveying the electrostatic image developer in an axial direction of the developer carrier; a mixing conveyor disposed on a lower side of the supply conveyor in a gravity direction, the mixing conveyor conveying the electrostatic image developer in the axial direction of the developer carrier while mixing the electrostatic image developer, the mixing conveyor conveying the electrostatic image developer in a direction opposite to a direction in which the supply conveyor conveys the electrostatic image developer; and a partition disposed between the supply conveyor and the mixing conveyor, wherein the electrostatic image developer is moved from the supply conveyor to the mixing conveyor through a first passage provided at one end portion of the partition, and the electrostatic image developer is moved from the mixing conveyor to the supply conveyor through a second passage provided at the other end portion of the partition.

BRIEF DESCRIPTION OF THE DRAWINGS

Exemplary embodiments of the present invention will be described in detail based on the following figures, wherein.

DETAILED DESCRIPTION

Hereafter, embodiments of the present invention will be described in detail.

Developing Device

A developing device according to this exemplary embodiment includes a developer container that accommodates an electrostatic image developer; a developer carrier that has a surface on which the electrostatic image developer is carried and that supplies the toner to an image carrier; a supply conveyor that supplies the electrostatic image developer to the surface of the developer carrier while conveying the electrostatic image developer in an axial direction of the developer carrier; a mixing conveyor disposed on a lower side of the supply conveyor in a gravity direction, the mixing conveyor conveying the electrostatic image developer in the axial direction of the developer carrier while mixing the electrostatic image developer, the mixing conveyor conveying the electrostatic image developer in a direction opposite to a direction in which the supply conveyor conveys the electrostatic image developer; and a partition disposed between the supply conveyor and the mixing conveyor, wherein the electrostatic image developer is moved from the supply conveyor to the mixing conveyor through a first passage provided at one end portion of the partition, and the electrostatic image developer is moved from the mixing conveyor to the supply conveyor through a second passage provided at the other end portion of the partition.

The developer container accommodates an electrostatic image developer including toner containing a toner particle and a zinc stearate particle externally added to the toner particle, and the ratio ($D_T/D_S$) of the volume-average particle size ($D_T$) of the toner particle to the volume-average particle size ($D_S$) of the zinc stearate particle is about 1.9 or more.

The configuration of the developing device according to this exemplary embodiment will be described with reference to the attached drawings.

Figure 1:
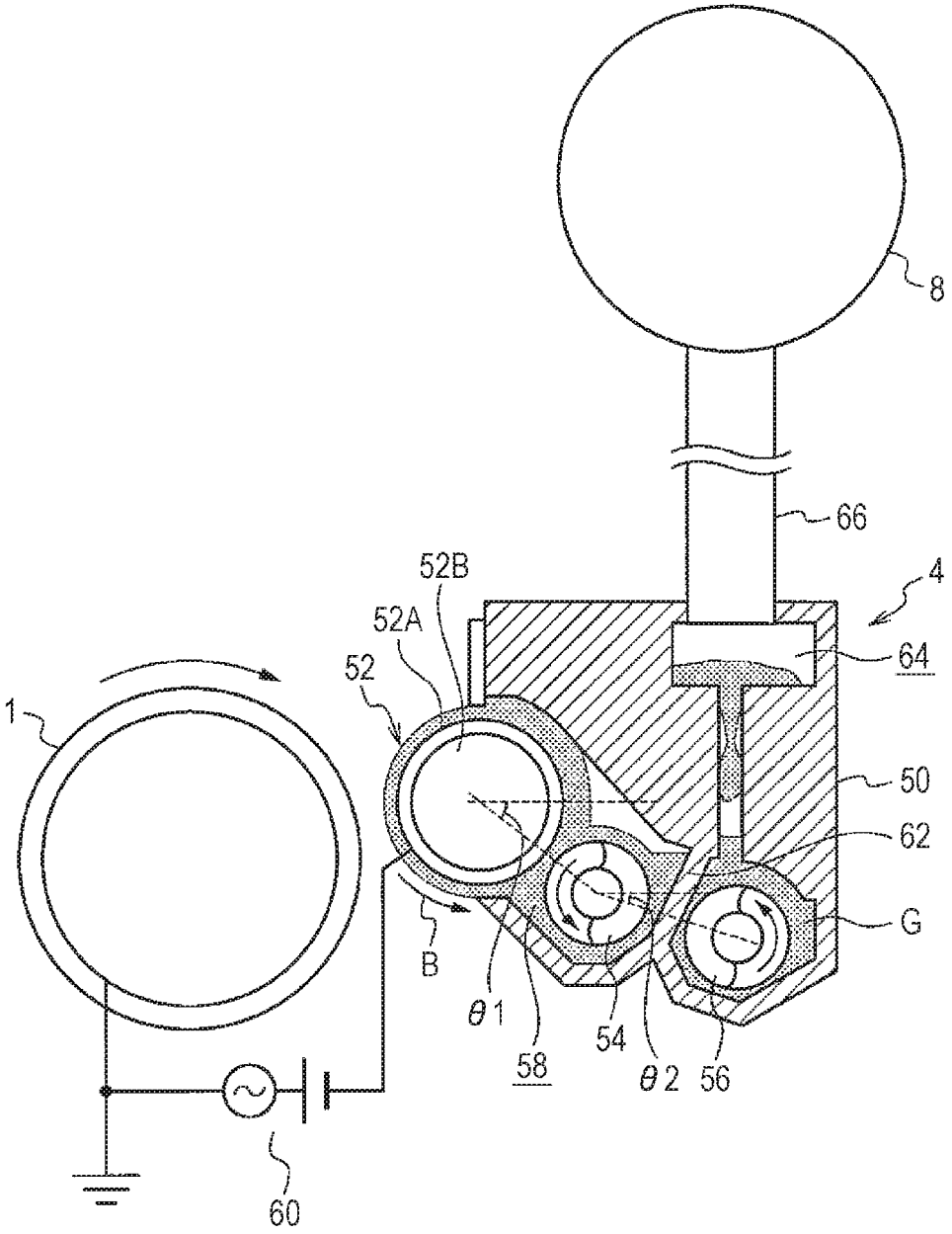
FIG. 1 schematically illustrates an example of a developing device according to this exemplary embodiment.
Figure 2:
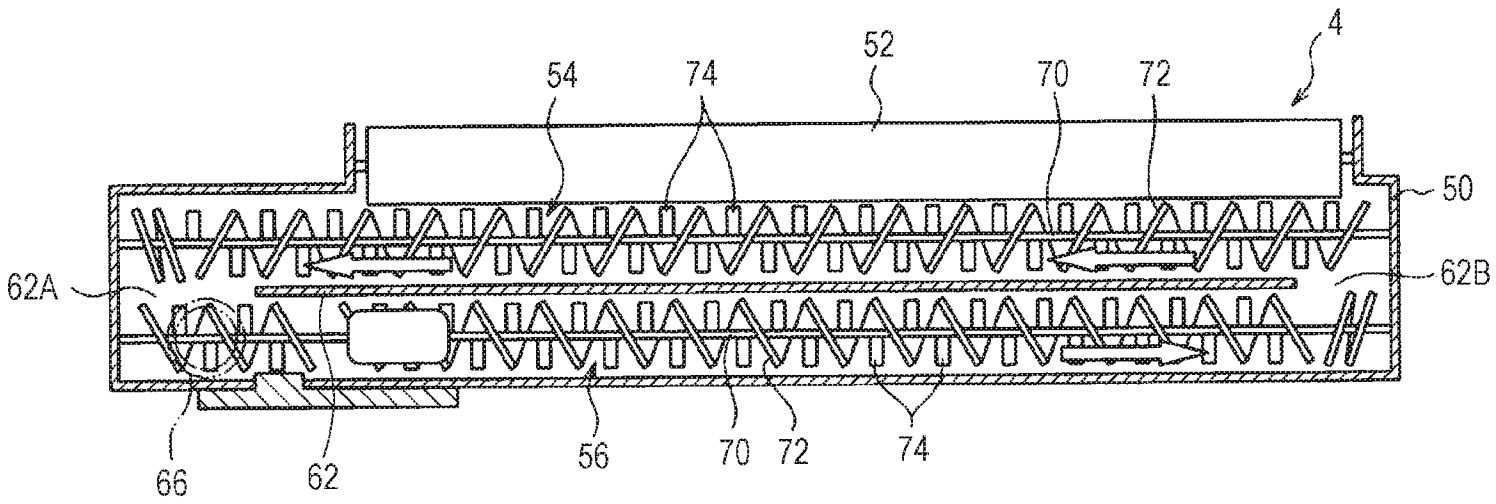
FIG. 2 schematically illustrates an example of a developing device according to this exemplary embodiment.

FIG. 1 is a sectional view illustrating an example of the developing device according to this exemplary embodiment and viewed in an axial direction of a developer carrier (developing roller). FIG. 2 is a sectional view illustrating the developer carrier (developing roller), a supply conveyor (supply auger), and a mixing conveyor (admixing auger) in the developing device in FIG. 1 and viewed in a radial direction of the developing roller.

A developing device 4 performs development with a developer (electrostatic image developer) G. The developing device 4 may be a two-component developing device that uses, as the developer G, a two-component developer containing carrier and toner.

As illustrated in FIG. 1 and FIG. 2, the developing device 4 includes a developer container 58 inside a housing 50 and a developing roller 52 serving as a developer carrier and located so as to face a photosensitive member (image carrier) 1 while at least part of the developing roller 52 is disposed in the developer container 58. The developing device 4 also includes a supply conveyor (supply auger) 54 that is disposed on the rear side of the developing roller 52 opposite the photosensitive member 1 and on the lower side of the developing roller 52 in the gravity direction and that supplies a developer G to the surface of the developing roller 52 while conveying the developer G under stirring in the axial direction of the developing roller 52. The supply conveyor (supply auger) 54 may be disposed at a position horizontal to the developing roller 52 or may be disposed on the upper side of the developing roller 52 in the gravity direction. The developing device 4 also includes a mixing conveyor (admixing auger) 56 that is disposed on the rear side of the supply conveyor (supply auger) 54 opposite the developing roller 52 and on the lower side of the supply conveyor 54 in the gravity direction and that conveys the developer G in a direction opposite to the direction of the supply conveyor (supply auger) 54 while stirring and mixing the developer G in the axial direction of the developing roller 52.

As illustrated in FIG. 2, the supply auger 54 and the admixing auger 56 are separated with a partition plate 62 (partition) disposed therebetween. Passages 62A and 62B are provided at both end portions of the partition plate 62. At the passage (first passage) 62A, the developer G conveyed by the supply auger 54 is forcedly moved to the admixing auger 56. At the passage (second passage) 62B, the developer G conveyed by the admixing auger 56 is forcedly moved to the supply auger 54.

Furthermore, a feeding unit 64 into which toner supplied from a toner cartridge 8 through a toner supply tube 66 is temporarily stored is disposed above one end portion (near the passage 62A) of the admixing auger 56. An opening is formed in the bottom surface of the feeding unit 64, and a predetermined amount of toner is replenished to the one end portion of the admixing auger 56.

The supply of the toner and the conveyance of the developer G in this developing device 4 will be described.

In the developing device 4, as illustrated in FIG. 1 and FIG. 2, the toner is supplied to the feeding unit 64 from the toner cartridge 8 through the toner supply tube 66 little by little. The toner is then supplied into the housing 50 through the opening of the feeding unit 64. The developer G inside the housing 50 is conveyed in a circulated manner. Specifically, the developer G is moved to the supply auger 54 through the passage 62B while being stirred by rotation of the admixing auger 56. The developer G is moved to the admixing auger 56 through the passage 62A while being stirred by rotation of the supply auger 54. Herein, the toner of the developer G is subjected to triboelectrification so as to have a predetermined polarity by being mixed with carrier under stirring. Furthermore, the developer G conveyed while being stirred by the supply auger 54 is supplied to the developing roller 52 adjacent to the supply auger 54, and held on the surface of the developing roller 52 while a magnetic brush of the developer G is formed.

The magnetic brush of the developer G is conveyed by rotation of a sleeve 52A in a direction indicated by an arrow B. Herein, the layer thickness of the developer G on the surface of the developing roller 52 is regulated to a predetermined thickness when the developer G passes through a trimmer. When the developer G whose layer thickness has been regulated is conveyed to a development region that faces the photosensitive member 1, the toner in the developer G is electrostatically attached to an electrostatic image portion of the photosensitive member 1 by a development field formed at a developing bias applied to the sleeve 52A.

As described above, the admixing auger (mixing conveyor) 56 is disposed on the lower side of the supply auger (supply conveyor) 54 in the gravity direction. Therefore, the transfer of the developer G from the admixing auger 56 to the supply auger 54 through the passage 62B is performed in a direction against gravity. The pressure from the rotation of the admixing auger 56 and gravity are exerted in opposite directions, which applies a load to the developer G.

In the developer G, zinc stearate particles are externally added to toner particles as an external additive having a lubricating function. Some of the zinc stearate particles adhere to the surfaces of the toner particles and the other particles are present while being liberated (separated) from the toner particles. In the developer G conveyed in a circulated manner by the supply auger 54 and the admixing auger 56, however, the liberation (separation) of the zinc stearate particles more readily occurs at the passage 62B where a heavier load is applied. The liberated (separated) zinc stearate particles are unevenly distributed at the passage 62B, and the zinc stearate particles are unevenly supplied to the developing roller 52 at the end portion of the developing roller 52 in the axial direction on the side of the passage 62B. As a result, the zinc stearate particles are also unevenly supplied to the photosensitive member 1 at the end portion of the photosensitive member 1 in the axial direction on the side of the passage 62B. The zinc stearate particles are particles that impart a lubricating function. Therefore, an uneven amount of zinc stearate particles supplied to the surface of the photosensitive member 1 affects the progress of wear of the photosensitive member 1, which sometimes causes uneven wear (formation of steps due to the difference in progress speed of wear) in the photosensitive member 1.

In contrast, in this exemplary embodiment, an electrostatic image developer is accommodated in which the ratio ($D_T/D_S$) of the volume-average particle size ($D_T$) of the toner particles to the volume-average particle size ($D_S$) of the zinc stearate particles is 1.9 or about 1.9 or more. That is, the particle size of the zinc stearate particles relative to the toner particles is smaller than or equal to a particular particle size. When the zinc stearate particles are externally added to the toner particles so that the ratio of the particle sizes is within the above range, the ratio of the contact area between the zinc stearate particles and the toner particles to the surface area of the zinc stearate particles increases compared with the case where the ratio of the particle sizes is outside the above range. Consequently, it is believed that the zinc stearate particles more firmly adhere to the toner particles. This suppresses the liberation (separation) of the zinc stearate particles from the toner particles due to application of load.

Furthermore, the toner particles, which have a larger particle size, bear the load on the developer G and almost no load is applied to the zinc stearate particles, which have a smaller particle size. Also from this point of view, the liberation (separation) of the zinc stearate particles due to application of load is suppressed.

Thus, the liberation (separation) of the zinc stearate particles is suppressed even at the passage (second passage) 62B to which a heavier load is applied, which suppresses the uneven distribution of the zinc stearate particles at the passage 62B. As a result, uneven supply of the zinc stearate particles to the photosensitive member 1 is reduced, which is believed to suppress occurrence of uneven wear (formation of wear step) of the photosensitive member 1.

Particle Sizes ($D_T$) and ($D_S$)

The ratio ($D_T/D_S$) of the volume-average particle size ($D_T$) of the toner particles to the volume-average particle size ($D_S$) of the zinc stearate particles is 1.9 or about 1.9 or more. If the ratio ($D_T/D_S$) is less than 1.9, the occurrence of uneven wear in the photosensitive member (image carrier) is not suppressed.

The ratio ($D_T/D_S$) is preferably 2.1 or more and more preferably 2.3 or more.

For the upper limit, the ratio ($D_T/D_S$) is preferably 5.8 or less, more preferably 2.9 or less, and further preferably 2.4 or less to avoid poor electrification with toner.

The volume-average particle size ($D_S$) of the zinc stearate particles indicates a volume median diameter. The volume-average particle size ($D_S$) of the zinc stearate particles is preferably 1.0 μm or more and 6.0 μm or less, more preferably 1.5 μm or more and 5.0 μm or less, and further preferably 2.0 μm or more and 4.0 μm or less.

The volume-average particle size ($D_S$) of the zinc stearate particles is measured by the following method. The measurement instrument is a laser diffraction/scattering particle size analyzer "LA-920" (manufactured by HORIBA, Ltd.). The setting of measurement conditions and the analysis of measured data are performed using dedicated software "HORIBA, Ltd. LA-920 for Windows (registered trademark) WET (LA-920) Ver. 2.02" supplied with LA-920. The solvent for measurement is ion-exchanged water from which solid impurities and the like have been removed.

The volume-average particle size ($D_T$) of the toner particles is preferably 2 μm or more and 12 μm or less, more preferably 3 μm or more and 8 μm or less, and further preferably 4 μm or more and 7 μm or less.

A method for measuring the volume-average particle size ($D_T$) of the toner particles will be described later.

Aspect Ratio

The zinc stearate particles may have a thin-layer shape or a substantially thin-layer shape. When the zinc stearate particles have a thin-layer shape or a substantially thin-layer shape, the particle size (volume-average particle size) corresponds to a length of the particles in a major axis direction.

When the zinc stearate particles have a thin-layer shape or a substantially thin-layer shape, the aspect ratio (the ratio [L/S] of the length [L] in the major axis direction (i.e., volume-average particle size) to the length [S] in the minor axis direction (the thickness direction of the thin-layer shape)) is preferably 2 or about 2 or more and 20 or about 20 or less, more preferably 4 or about 4 or more and 20 or about 20 or less, and further preferably 6 or about 6 or more and 20 or about 20 or less.

When the zinc stearate particles have a thin-layer shape or a substantially thin-layer shape that satisfies the above-described aspect ratio, zinc stearate particles externally added to toner particles tend to adhere to the toner particles so that the minor axis direction (thickness direction) points to the toner particles (i.e., the plane of the substantially thin-layer shape is in contact with the toner particles). Therefore, the contact area with the toner particles increases compared with the case where the zinc stearate particles have a spherical shape. This further increases the ratio of the contact area between the zinc stearate particles and the toner particles to the surface area of the zinc stearate particles. As a result, the liberation (separation) of the zinc stearate particles from the toner particles due to application of load is further suppressed.

Moreover, the load on the developer G is further lightened for the zinc stearate particles having a thin-layer shape or a substantially thin-layer shape compared with zinc stearate particles having a spherical shape. Also from this point of view, the liberation (separation) of the zinc stearate particles due to application of load is suppressed.

Thus, the liberation (separation) of the zinc stearate particles is further suppressed even at the passage (second passage) 62B to which a heavier load is applied, which suppresses the uneven distribution of the zinc stearate particles at the passage 62B. As a result, the occurrence of uneven wear (formation of wear step) in the photosensitive member is believed to be suppressed.

The aspect ratio of the zinc stearate particles is measured by the following method.

An image captured using a scanning electron microscope (SEM, product name: SU 8010 manufactured by Hitachi High-Technologies Corporation) is subjected to particle shape analysis using image analysis software (product name: WinROOF manufactured by MITANI Corporation) supplied with the microscope.

Hereafter, the configuration of the developing device according to this exemplary embodiment will be more specifically described.

First, a developer (electrostatic image developer) accommodated in the developing device will be described. In this exemplary embodiment, the developer may be a one-component developer containing toner or a two-component developer containing carrier and toner, but the two-component developer may be particularly used.

Toner

The toner used in this exemplary embodiment contains toner particles and zinc stearate particles serving as an external additive.

Toner Particles

The toner particles contain, for example, a binder resin and optionally a coloring agent, a release agent, and other additives.

Binder Resin

Examples of the binder resin include vinyl resins formed of homopolymers obtained by polymerizing a monomer such as a styrene (e.g., styrene, parachlorostyrene, and α-methylstyrene), a (meth)acrylate (e.g., methyl acrylate, ethyl acrylate, n-propyl acrylate, n-butyl acrylate, lauryl acrylate, 2-ethyhexyl acrylate, methyl methacrylate, ethyl methacrylate, n-propyl methacrylate, lauryl methacrylate, and 2-ethyhexyl methacrylate), an ethylenically unsaturated nitrile (e.g., acrylonitrile and methacrylonitrile), a vinyl ether (e.g., vinyl methyl ether and vinyl isobutyl ether), a vinyl ketone (e.g., vinyl methyl ketone, vinyl ethyl ketone, and vinyl isopropenyl ketone), or an olefin (e.g., ethylene, propylene, and butadiene); and vinyl resins formed of copolymers obtained by combining two or more of the above monomers.

Other examples of the binder resin include resins other than vinyl resins, such as epoxy resin, polyester resin, polyurethane resin, polyamide resin, cellulose resin, polyether resin, and modified rosin; mixtures of such resins and the above vinyl resins; and graft polymers obtained by polymerizing vinyl monomers under coexistence of such resins.

These binder resins may be used alone or in combination of two or more.

The binder resin is suitably a polyester resin.

The polyester resin is, for example, a publicly known polyester resin.

Examples of the polyester resin include polycondensates of polycarboxylic acids and polyhydric alcohols. The polyester resin may be a commercially available polyester resin or a synthetic polyester resin.

Examples of the polycarboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower alkyl esters (for example, 1 to 5 carbon atoms) of the foregoing. Among them, the polycarboxylic acid may be, for example, an aromatic dicarboxylic acid.

The polycarboxylic acid may contain, in combination, dicarboxylic acids and bridged or branched carboxylic acids having a functionality of three or more. Examples of carboxylic acids having a functionality of three or more include trimellitic acid, pyromellitic acid, and anhydrides and lower alkyl esters (for example, 1 to 5 carbon atoms) of the foregoing.

These polycarboxylic acids may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., bisphenol A-ethylene oxide adduct and bisphenol A-propylene oxide adduct). Among them, the polyhydric alcohol is, for example, preferably an aromatic diol or an alicyclic diol and more preferably an aromatic diol.

The polyhydric alcohol may contain, in combination, diols and bridged or branched polyhydric alcohols having a functionality of three or more. Examples of polyhydric alcohols having a functionality of three or more include glycerol, trimethylolpropane, and pentaerythritol.

These polyhydric alcohols may be used alone or in combination of two or more.

The glass transition temperature (Tg) of the polyester resin is preferably 50° C. or higher and 80° C. or lower and more preferably 50° C. or higher and 65° C. or lower.

The glass transition temperature is determined from a differential scanning calorimetry (DSC) curve obtained by DSC. More specifically, the glass transition temperature is determined as an extrapolated glass transition onset temperature defined in the "Determination of Glass Transition Temperature" section of JIS K 7121-1987 "Testing Methods for Transition Temperatures of Plastics".

The weight-average molecular weight (Mw) of the polyester resin is preferably 5000 or more and 1000000 or less and more preferably 7000 or more and 500000 or less.

The number-average molecular weight (Mn) of the polyester resin is preferably 2000 or more and 100000 or less.

The molecular weight distribution Mw/Mn of the polyester resin is preferably 1.5 or more and 100 or less and 2 or more and 60 or less.

The weight-average molecular weight and the number-average molecular weight are determined by gel permeation chromatography (GPC). The measurement of molecular weight by GPC is performed with a Tosoh HLC-8120 GPC system equipped with a Tosoh TSKgel Super HM-M column (15 cm) using a tetrahydrofuran (THF) solvent. A molecular weight calibration curve is obtained from monodisperse polystyrene standards, and the weight-average molecular weight and the number-average molecular weight are determined from the measurement results using the molecular weight calibration curve.

The polyester resin is produced by a well-known method. Specifically, for example, the polyester resin is produced by performing polymerization at 180° C. or higher and 230° C. or lower optionally while the pressure in the reaction system is reduced and water and alcohol generated during condensation are removed.

If any starting monomer is insoluble or immiscible at the reaction temperature, it may be dissolved using a high-boiling-point solvent as a solubilizer. In this case, the polycondensation reaction is performed while the solubilizer is distilled off. If a poorly miscible monomer is present in a copolymerization reaction, the poorly miscible monomer may be condensed with an acid or alcohol to be polycondensed with the monomer before being polycondensed with the major component.

The content of the binder resin is, for example, preferably 40% by mass or more and 95% by mass or less, more preferably 50% by mass or more and 90% by mass or less, and 60% by mass or more and 85% by mass or less relative to the total mass of the toner particles.

Coloring Agent

Examples of the coloring agent include various pigments such as carbon black, chrome yellow, hansa yellow, benzidine yellow, threne yellow, quinoline yellow, pigment yellow, permanent orange GTR, pyrazolone orange, vulcan orange, watching red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These coloring agents may be used alone or in combination of two or more.

Optionally, the coloring agent may be surface-treated or may be used in combination with a dispersant. The coloring agent may be a combination of different coloring agents.

The content of the coloring agent is, for example, preferably 1% by mass or more and 30% by mass or less and more preferably 3% by mass or more and 15% by mass or less relative to the total mass of the toner particles.

Release Agent

Non-limiting examples of the release agent include hydrocarbon waxes; natural waxes such as carnauba wax, rice wax, and candelilla wax; synthetic, mineral, and petroleum waxes such as montan wax; and ester waxes such as fatty acid esters and montanic acid esters.

The melting temperature of the release agent is preferably 50° C. or higher and 110° C. or lower and more preferably 60° C. or higher and 100° C. or lower.

The melting temperature is determined from a DSC curve obtained by DSC as a melting peak temperature defined in the "Determination of Melting Temperature" section of JIS K 7121-1987 "Testing Methods for Transition Temperatures of Plastics".

The content of the release agent is, for example, preferably 1% by mass or more and 20% by mass or less and more preferably 5% by mass or more and 15% by mass or less relative to the total mass of the toner particles.

Other Additives

Other additives are, for example, well-known additives such as magnetic materials, charge control agents, and inorganic powders. These additives are contained in the toner particles as internal additives.

Properties of Toner Particles

The toner particles may be single-layer toner particles or core-shell toner particles including a core portion (core particle) and a coating layer (shell layer) covering the core portion.

Herein, the core-shell toner particles may include a core portion containing a binder resin and other optional additives such as a coloring agent and a release agent and a coating layer containing a binder resin.

The volume-average particle size (D50v) of the toner particles is preferably 2 μm or more and 10 μm or less and more preferably 4 μm or more and 8 μm or less.

The various average particle sizes and particle size distribution indices of the toner particles are determined with a Coulter Multisizer II (manufactured by Beckman Coulter, Inc.) using Isoton-II (manufactured by Beckman Coulter, Inc.) as an electrolyte.

For measurement, 0.5 mg or more and 50 mg or less of a test sample is added to 2 mL of a 5% aqueous solution of a surfactant (e.g., sodium alkylbenzenesulfonate) serving as a dispersant. The mixture is added to 100 mL or more and 150 mL or less of the electrolyte.

The sample suspended in the electrolyte is dispersed using an ultrasonic disperser for one minute. The particle size distribution of particles having a particle size of 2 μm or more and 60 μm or less is measured with a Coulter Multisizer II using an aperture having an aperture size of 100 μm. The number of particles subjected to sampling is 50000.

The resulting particle size distribution is divided into particle size sections (channels). Cumulative volume and number distributions are drawn from smaller particle sizes. The volume particle size D16v is defined as a particle size at which the cumulative volume is 16%. The number particle size D16p is defined as a particle size at which the cumulative number is 16%. The volume-average particle size D50v is defined as a particle size at which the cumulative volume is 50%. The number-average particle size D50p is defined as a particle size at which the cumulative number is 50%. The volume particle size D84v is defined as a particle size at which the cumulative volume is 84%. The number particle size D84p is defined as a particle size at which the cumulative number is 84%.

From these particle sizes, the volume particle size distribution index (GSDv) is calculated as $(D84v/D16v)^{1/2}$, and the number particle size distribution index (GSDp) is calculated as $(D84p/D16p)^{1/2}$.

The shape factor SF1 of the toner particles is preferably 110 or more and 150 or less and more preferably 120 or more and 140 or less.

The shape factor SF1 is determined from the following formula.

$$SF1=(ML^2/A)\times(\pi/4)\times 100$$

where ML is the absolute maximum length of the toner particles, and A is the projected area of the toner particles.

Specifically, the shape factor SF1 is numerically determined by analyzing a microscope image or a scanning electron microscope (SEM) image using an image analyzer. That is, the shape factor SF1 is determined as follow. An optical microscope image of particles dispersed over a surface of a glass slide is captured into a Luzex image analyzer with a video recorder. The maximum lengths and projected areas of 100 particles are determined and are substituted into the above formula. The shape factors of individual particles are averaged to obtain the shape factor SF1.

External Additive

The external additive contains zinc stearate particles. Zinc stearate particles that satisfy a particular ratio ($D_T/D_S$) of the volume-average particle size ($D_T$) of the toner particles to the volume-average particle size ($D_S$) of the zinc stearate particles are used.

The external additive may contain other external additives in addition to the zinc stearate particles.

The zinc stearate particles may be particles formed of only zinc stearate or particles formed of zinc stearate and other components. The other components are, for example, higher fatty acid alcohols. Note that the zinc stearate particles contain 10% by mass or more of zinc stearate.

The amount of zinc stearate particles externally added is, for example, preferably 0.01% by mass or more and 2.0% by mass or less, more preferably 0.05% by mass or more and 1.5% by mass or less, and 0.05% by mass or more and 1.2% by mass or less relative to the toner particles.

The other external additives are, for example, inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment is performed, for example, by immersing the inorganic particles in a hydrophobizing agent. Non-limiting examples of the hydrophobizing agent include silane coupling agents, silicone oil, titanate coupling agents, and aluminum coupling agents. These hydrophobizing agents may be used alone or in combination of two or more.

The hydrophobizing agent is typically used in an amount of, for example, 1 part by mass or more and 10 parts by mass or less relative to 100 parts by mass of the inorganic particles.

Other examples of the external additive include resin particles (e.g., resin particles such as polystyrene, polymethyl methacrylate (PMMA), and melamine resin particles) and cleaning active agents (e.g., particles of higher fatty acid metal salts other than zinc stearate, and fluoropolymer particles).

The amount of the external additive added is, for example, preferably 0.01% by mass or more and 5% by mass or less and more preferably 0.01% by mass or more and 2.0% by mass or less relative to the toner particles.

Method for Producing Toner

Next, a method for producing the toner according to this exemplary embodiment will be described.

The toner according to this exemplary embodiment is produced by producing toner particles and then adding an external additive to the toner particles.

The toner particles may be produced either by a dry process (e.g., pulverization) or by a wet process (e.g., aggregation coalescence, suspension polymerization, and dissolution suspension). The process for producing toner particles is not particularly limited to the above processes for producing toner particles, and a well-known process may be employed.

Among them, the toner particles may be produced by aggregation coalescence.

Specifically, for example, the toner particles are produced by aggregation coalescence as follows.

The toner particles are produced through a step of providing a resin particle dispersion liquid in which resin particles serving as a binder resin are dispersed (resin-particle-dispersion-liquid providing step), a step of aggregating the resin particles (and optionally other particles) in the resin particle dispersion liquid (if necessary, in a dispersion liquid prepared by mixing other particle dispersion liquids) to form aggregated particles (aggregated-particle forming step), and a step of heating an aggregated particle dispersion liquid in which the aggregated particles are dispersed to coalesce the aggregated particles, thereby forming toner particles (coalescing step).

Hereafter, each of the steps will be described in detail.

Although the method for producing toner particles containing a coloring agent and a release agent will be described below, the coloring agent and the release agent are optional additives. Obviously, additives other than the coloring agent and the release agent may be used.

Resin-Particle-Dispersion-Liquid Providing Step

There are provided a resin particle dispersion liquid in which resin particles serving as a binder resin are dispersed and, for example, a coloring agent particle dispersion liquid in which coloring agent particles are dispersed and a release agent particle dispersion liquid in which release agent particles are dispersed.

Herein, the resin particle dispersion liquid is prepared, for example, by dispersing resin particles in a dispersion medium using a surfactant.

The dispersion medium used for the resin particle dispersion liquid is, for example, an aqueous medium.

Examples of the aqueous medium include water, such as distilled water and ion-exchanged water, and alcohols. These aqueous media may be used alone or in combination of two or more.

Examples of the surfactant include anionic surfactants such as sulfates, sulfonates, phosphates, and soaps; cationic surfactants such as amine salts and quaternary ammonium salts; and nonionic surfactants such as polyethylene glycol, alkylphenol-ethylene oxide adducts, and polyhydric alcohols. For example, anionic and cationic surfactants may be used. Nonionic surfactants may be used in combination with anionic and cationic surfactants.

These surfactants may be used alone or in combination of two or more.

In the resin particle dispersion liquid, the resin particles are dispersed in the dispersion medium, for example, by common dispersion processes using a machine such as a rotary shear homogenizer or a media mill such as a ball mill, a sand mill, or a Dyno-Mill. Alternatively, the resin particles may be dispersed in the resin particle dispersion liquid by phase-inversion emulsification.

In phase-inversion emulsification, the resin to be dispersed is dissolved in a hydrophobic organic solvent in which the resin is soluble. After the organic continuous phase (O-phase) is neutralized with a base, an aqueous medium (W-phase) is added to cause resin conversion (i.e., phase inversion) from water-in-oil (W/O) to oil-in-water (O/W), thereby forming a discontinuous phase. Thus, the resin is dispersed in the form of particles in the aqueous medium.

The volume-average particle size of the resin particles dispersed in the resin particle dispersion liquid is, for example, preferably 0.01 μm or more and 1 μm or less, more preferably 0.08 μm or more and 0.8 μm or less, and further preferably 0.1 μm or more and 0.6 μm or less.

The volume-average particle size of the resin particles is determined as follows. A particle size distribution is obtained using a laser diffraction particle size analyzer (e.g., LA-700 manufactured by Horiba, Ltd.) and is divided into particle size sections (channels). A cumulative volume distribution is drawn from smaller particle sizes. The volume average particle size D50v is determined as a particle size at which the cumulative volume is 50% of all particles. The volume-average particle sizes of particles dispersed in other dispersion liquids are also determined in the same manner.

The content of the resin particles in the resin particle dispersion liquid is, for example, preferably 5% by mass or more and 50% by mass or less and more preferably 10% by mass or more and 40% by mass or less.

For example, the coloring agent particle dispersion liquid and the release agent particle dispersion liquid are also prepared in the same manner as the resin particle dispersion liquid. That is, the volume-average particle size, dispersion medium, dispersion process, and content of the coloring agent particles dispersed in the coloring agent particle dispersion liquid and the release agent particles dispersed in the release agent particle dispersion liquid are similar to those of the particles in the resin particle dispersion liquid.

Aggregated-Particle Forming Step

Subsequently, the resin particle dispersion liquid, the coloring agent particle dispersion liquid, and the release agent particle dispersion liquid are mixed with each other.

The resin particles, the coloring agent particles, and the release agent particles are subjected to heteroaggregation in the mixed dispersion liquid to form aggregated particles including the resin particles, the coloring agent particles, and the release agent particles and having a particle size close to that of the toner particles.

Specifically, the aggregated particles are formed, for example, by adding a coagulant to the mixed dispersion liquid, adjusting the pH of the mixed dispersion liquid to an acidic pH (e.g., a pH of 2 to 5), optionally adding a dispersion stabilizer, and then heating the mixed dispersion liquid to aggregate the particles dispersed therein. Herein, the mixed dispersion liquid is heated to the glass transition temperature of the resin particles (e.g., 10° C. to 30° C. lower than the glass transition temperature of the resin particles).

The aggregated-particle forming step may be performed, for example, by adding a coagulant to the mixed dispersion liquid at room temperature (e.g., 25° C.) under stirring with a rotary shear homogenizer, adjusting the pH of the mixed dispersion liquid to an acidic pH (e.g., a pH of 2 to 5), optionally adding a dispersion stabilizer, and then performing the above heating.

Examples of the coagulant include surfactants having a polarity opposite to that of the surfactant used as a dispersant added to the mixed dispersion liquid, inorganic metal salts, and metal complexes with a valence of two or more. In particular, when metal complexes are used as the coagulant, the amount of surfactant used is reduced and thus the charging characteristics are improved.

An additive that forms a complex or a similar linkage with metal ions of the coagulant may be optionally used. An example of the additive is a chelating agent.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of the chelating agent include oxycarboxylic acids such as tartaric acid, citric acid, and gluconic acid; iminodiacetic acid (IDA); nitrilotriacetic acid (NTA); and ethylenediaminetetraacetic acid (EDTA).

The amount of the chelating agent added is, for example, preferably 0.01 parts by mass or more and 5.0 parts by mass or less and more preferably 0.1 parts by mass or more and less than 3.0 parts by mass relative to 100 parts by mass of the resin particles.

Coalescing Step

Subsequently, the aggregated particle dispersion liquid in which the aggregated particles are dispersed is heated, for example, to a temperature higher than or equal to the glass transition temperature of the resin particles (e.g., 10° C. to 30° C. higher than the glass transition temperature of the resin particles) to coalesce the aggregated particles, thereby forming toner particles.

Through the above steps, toner particles are obtained.

Alternatively, the toner particles may be produced through a step of, after the aggregated particle dispersion liquid in which the aggregated particles are dispersed is obtained, mixing the aggregated particle dispersion liquid with a resin particle dispersion liquid in which the resin particles are dispersed and further causing the resin particles to adhere to the surfaces of the aggregated particles to form second aggregated particles; and a step of heating the second aggregated particle dispersion liquid in which the second aggregated particles are dispersed to coalesce the second aggregated particles, thereby forming core/shell toner particles.

Upon completion of the coalescing step, the toner particles formed in the dispersion liquid are subjected to publicly known washing, solid-liquid separating, and drying steps to obtain dry toner particles.

In the washing step, the toner particles may be sufficiently washed by displacement washing with ion-exchanged water from the viewpoint of charging characteristics. The solid-liquid separating step is not particularly limited, and a process such as suction filtration or pressure filtration may be employed from the viewpoint of productivity. The drying step is also not particularly limited, and a process such as freeze drying, flush jet drying, fluidized bed drying, or vibrating fluidized bed drying may be employed from the viewpoint of productivity.

The toner according to this exemplary embodiment is produced, for example, by mixing the resulting dry toner particles with an external additive. The mixing may be performed, for example, using a machine such as a V-blender, a Henschel mixer, and a Loedige mixer. Optionally, coarse toner particles may be removed using a machine such as a vibrating screen or an air screen.

Electrostatic Image Developer

An electrostatic image developer used in this exemplary embodiment contains at least the above-described toner.

The electrostatic image developer used in this exemplary embodiment may be a one-component developer containing only the above-described toner or a two-component developer containing the toner and a carrier.

The carrier may be any publicly known carrier. Examples of the carrier include coated carriers obtained by coating surfaces of cores made of a magnetic powder with a coating resin, magnetic-powder-dispersed carriers obtained by dispersing a magnetic powder in a matrix resin, and resin-impregnated carriers obtained by impregnating a porous magnetic powder with a resin.

The magnetic-powder-dispersed carriers and the resin-impregnated carriers may be carriers obtained by using the constituent particles of the carriers as cores and coating the cores with a coating resin.

Examples of the magnetic powder include powders of magnetic metals such as iron, nickel, and cobalt and powders of magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins containing organosiloxane bonds and modified products thereof, fluoropolymers, polyesters, polycarbonates, phenolic resins, and epoxy resins.

The coating resin and the matrix resin may contain other additives such as conductive particles.

Examples of the conductive particles include particles of metals such as gold, silver, and copper; and particles of carbon black, titanium oxide, zinc oxide, tin oxide, barium sulfate, aluminum borate, and potassium titanate.

The surfaces of the cores are coated with the coating resin, for example, by dissolving the coating resin and optionally various additives in a suitable solvent and coating the cores with the resulting solution for forming the coating layer. The solvent may be any solvent selected depending on, for example, the coating resin used and the suitability for coating.

Examples of specific resin coating methods include a dipping method in which the cores are dipped in the solution for forming the coating layer; a spraying method in which the surfaces of the cores are sprayed with the solution for forming the coating layer; a fluidized bed coating method in which the cores are sprayed with the solution for forming the coating layer while being suspended in air stream; and a kneader coating method in which the carrier cores and the solution for forming the coating layer are mixed in a kneader coater and the solvent is then removed.

The mixing ratio (mass ratio) of the toner and the carrier in the two-component developer is preferably toner:carrier=1:100 to 30:100 and more preferably 3:100 to 20:100.

Other Configurations of Developing Device

Next, each member constituting the developing device 4 will be described.

As illustrated in FIG. 1 and FIG. 2, the developing device 4 includes a developing roller 52 serving as a developer carrier and disposed inside a housing 50 so as to face a photosensitive member (image carrier) 1. The developing device 4 also includes a supply conveyor (supply auger) 54 that is disposed on the rear side of the developing roller 52 opposite the photosensitive member 1 and on the lower side of the developing roller 52 in the gravity direction and that supplies a developer G to the surface of the developing roller 52 while conveying the developer G under stirring in the axial direction of the developing roller 52. The supply conveyor (supply auger) 54 may be disposed at a position horizontal to the developing roller 52 or may be disposed on the upper side of the developing roller 52 in the gravity direction. The developing device 4 also includes a mixing conveyor (admixing auger) 56 that is disposed on the rear side of the supply conveyor (supply auger) 54 opposite the developing roller 52 and on the lower side of the supply conveyor 54 in the gravity direction and that conveys the developer G in a direction opposite to the direction of the supply conveyor (supply auger) 54 while stirring and mixing the developer G in the axial direction of the developing roller 52.

The supply conveyor (supply auger) 54 may be disposed at a position horizontal to the developing roller 52, may be disposed on the lower side of the developing roller 52 in the gravity direction, or may be disposed on the upper side of the developing roller 52 in the gravity direction.

Although FIG. 1 illustrates an exemplary embodiment in which the angle (θ1) formed by a straight line joining the central axis of the supply conveyor (supply auger) 54 and the central axis of the developing roller 52 with respect to a horizontal direction increases downward in the gravity direction, this exemplary embodiment is not limited thereto.

The mixing conveyor (admixing auger) 56 is disposed on the lower side of the supply conveyor (supply auger) 54 in the gravity direction.

The angle (θ2) formed by a straight line joining the central axis of the mixing conveyor (admixing auger) 56 and the central axis of the supply conveyor (supply auger) 54 with respect to a horizontal direction is preferably 10° or more and 50° or less, more preferably 15° or more and 45° or less, and further preferably 20° or more and 40° or less from the viewpoint of space saving.

A trimmer that regulates the layer thickness of a developer G conveyed while a magnetic brush is formed on the developing roller 52 is disposed in an upper portion of the housing 50 that faces the developing roller 52.

The developing roller 52 includes a cylindrical sleeve 52A made of a non-magnetic conductive material and a magnet roller 52B disposed inside the hollow of the sleeve 52A. The magnet roller 52B is fixedly supported and the sleeve 52A is rotated in a direction indicated by an arrow B by a driving source (not illustrated). A predetermined developing bias is applied to the sleeve 52A from a developing bias supply 60. The photosensitive member 1 is grounded.

Figure 3:
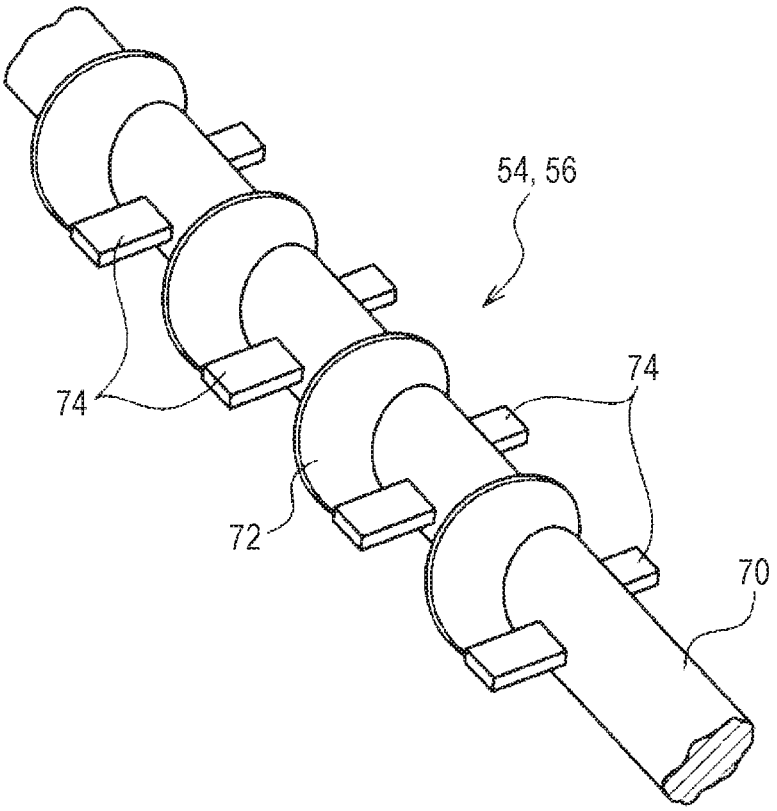
FIG. 3 schematically illustrates an example of a conveyor used in the developing device according to this exemplary embodiment.

As illustrated in FIG. 3, the supply auger 54 and the admixing auger 56 each include a helical protrusion 72 serving as an impeller on the peripheral surface of a columnar shaft 70. Furthermore, plate-shaped projections 74 projecting from the shaft 70 may be disposed between adjacent portions of the helical protrusion 72. The projections 74 may be disposed at positions of 0° and 180° in the circumferential direction of the shaft 70 in a single pitch of the helical protrusion 72. The multiple projections 74 are formed so that the plate-shaped surface extends in the axial direction of the shaft 70.

The helical protrusion 72 and the multiple projections 74 may be formed of an elastic member whose surface is deformed upon contact with the developer G. The elastic member is made of a material such as ethylene-propylene-diene rubber (EPDM) or chloroprene (CR). Furthermore, a metal filler (e.g., $SnO_2$ particles, $ZnO_2$ particles, and Al particles) may be added to increase the rigidity of the elastic member. The amount of the metal filler added may be 30% by mass or more.

In addition to the helical protrusion illustrated in FIG. 3, the helical impeller may be a screw-shaped spiral impeller having a predetermined pitch.

Next, an image forming apparatus and the like that include the developing device according to this exemplary embodiment will be described.

Image Forming Apparatus and Image Forming Method

An image forming apparatus and an image forming method according to this exemplary embodiment will be described.

The image forming apparatus according to this exemplary embodiment includes an image carrier; a charging unit that charges a surface of the image carrier; an electrostatic image forming unit that forms an electrostatic image on the charged surface of the image carrier; a developing unit that accommodates an electrostatic image developer and develops, as a toner image, the electrostatic image formed on the surface of the image carrier with the electrostatic image developer; a transferring unit that transfers the toner image formed on the surface of the image carrier onto a surface of a recording medium; and a fixing unit that fixes the toner image transferred onto the surface of the recording medium. In the developing unit, the developing device according to this exemplary embodiment is employed.

In the image forming apparatus according to this exemplary embodiment, an image forming method (image forming method according to this exemplary embodiment) is performed which includes charging a surface of an image carrier; forming an electrostatic image on the charged surface of the image carrier; developing, as a toner image, the electrostatic image formed on the surface of the image carrier with the developing device according to this exemplary embodiment; transferring the toner image formed on the surface of the image carrier onto a surface of a recording medium; and fixing the toner image transferred onto the surface of the recording medium.

The image forming apparatus according to this exemplary embodiment is applicable to well-known image forming apparatuses such as a direct-transfer image forming apparatus in which a toner image formed on a surface of an image carrier is directly transferred onto a recording medium, an intermediate-transfer image forming apparatus in which a toner image formed on a surface of an image carrier is subjected to first transfer onto a surface of an intermediate transfer body and the toner image transferred onto the surface of the intermediate transfer body is subjected to second transfer onto a surface of a recording medium, an image forming apparatus including a cleaning unit that cleans a surface of an image carrier before charging and after transfer of a toner image, and an image forming apparatus including a charge eraser that erases electricity by irradiating a surface of an image carrier with erasing light before charging and after transfer of a toner image.

In the case of an intermediate-transfer image forming apparatus, the transferring unit includes an intermediate transfer body having a surface onto which a toner image is to be transferred, a first transfer unit that transfers a toner image formed on a surface of an image carrier onto a surface of the intermediate transfer body, and a second transfer unit that transfers the toner image transferred onto the surface of the intermediate transfer body onto a surface of a recording medium.

In the image forming apparatus according to this exemplary embodiment, for example, the developing unit may be a part of a cartridge structure (process cartridge) detachably attachable to the image forming apparatus. The process cartridge is, for example, suitably a process cartridge including the developing device according to this exemplary embodiment.

Hereafter, an example of the image forming apparatus according to this exemplary embodiment will be described, but the image forming apparatus is not limited thereto. Only principal parts illustrated in the drawings are described, and the description of other parts is omitted.

Figure 4:
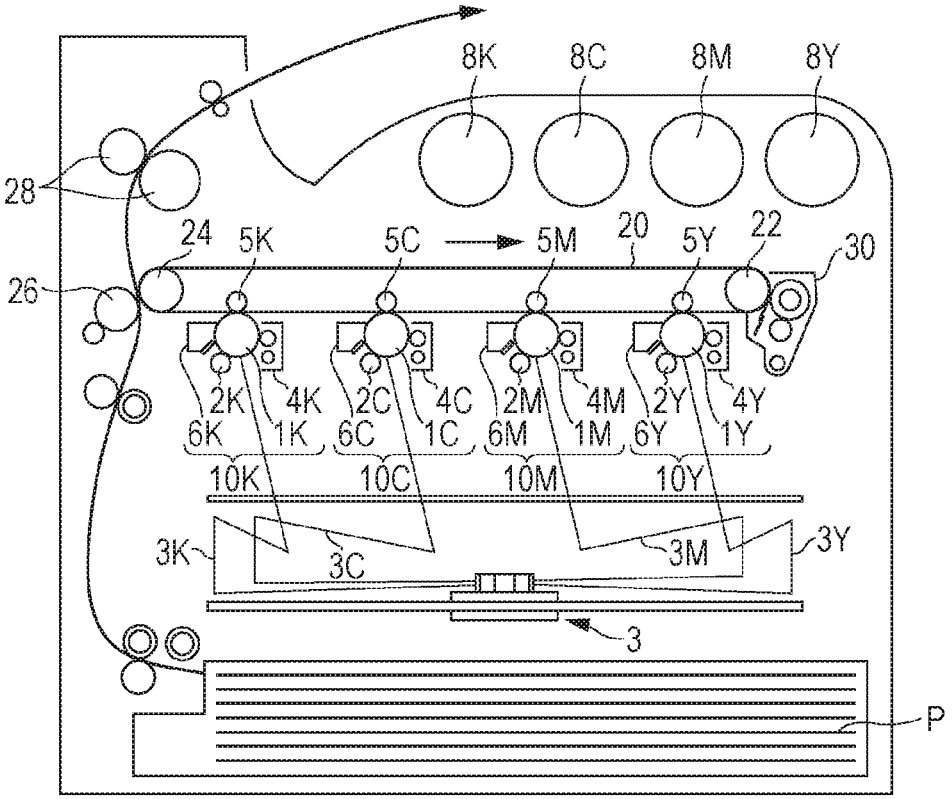
FIG. 4 schematically illustrates an example of an image forming apparatus according to this exemplary embodiment.

FIG. 4 schematically illustrates the image forming apparatus according to this exemplary embodiment.

The image forming apparatus illustrated in FIG. 4 includes first to fourth electrophotographic image forming units (hereinafter may be simply referred to as "units") 10Y, 10M, 10C, and 10K that form yellow (Y), magenta (M), cyan (C), and black (K) images, respectively, based on color separation image data. These image forming units 10Y, 10M, 10C, and 10K are arranged away from each other at predetermined intervals in the horizontal direction. These units 10Y, 10M, 10C, and 10K may be process cartridges detachably attachable to the image forming apparatus.

An intermediate transfer belt 20 serving as an intermediate transfer body is disposed above the units 10Y, 10M, 10C, and 10K in FIG. 4 so as to pass through each unit. The intermediate transfer belt 20 is wound around a drive roller 22 and a support roller 24, which are disposed in contact with the inner surface of the intermediate transfer belt 20 and are separated from each other in the direction from left to right in FIG. 4. The intermediate transfer belt 20 moves in a direction from the first unit 10Y toward the fourth unit 10K. A force is exerted on the support roller 24 by a spring (not illustrated) or the like in a direction away from the drive roller 22, and thus a particular tension is applied to the intermediate transfer belt 20 wound around the drive roller 22 and the support roller 24. An intermediate-transfer-body cleaning device 30 is disposed on the image carrier side of the intermediate transfer belt 20 so as to face the drive roller 22.

The units 10Y, 10M, 10C, and 10K include developing devices (developing units) 4Y, 4M, 4C, and 4K, respectively. The developing devices 4Y, 4M, 4C, and 4K are supplied with yellow, magenta, cyan, and black toners from toner cartridges 8Y, 8M, 8C, and 8K, respectively.

Since the first to fourth units 10Y, 10M, 10C, and 10K have the same configuration, the following description will focus on the first unit 10Y, which is a yellow image-forming unit disposed upstream in the moving direction of the intermediate transfer belt. Elements corresponding to those of the first unit 10Y are designated by like numerals with the suffix M (magenta), C (cyan), or K (black), instead of the suffix Y (yellow), and the description of the second to fourth units 10M, 10C, and 10K is omitted herein.

The first unit 10Y includes a photosensitive member 1Y serving as an image carrier. The photosensitive member 1Y is surrounded, in sequence, by a charging roller (an example of the charging unit) 2Y that charges the surface of the photosensitive member 1Y to a predetermined potential, an exposure device (an example of the electrostatic image forming unit) 3 that exposes the charged surface to a laser beam 3Y based on a color separation image signal to form an electrostatic image, a developing device (an example of the developing unit) 4Y that supplies a charged toner to the electrostatic image to develop the electrostatic image, a first transfer roller (an example of the first transfer unit) 5Y that transfers the resulting toner image onto an intermediate transfer belt 20, and a photosensitive member cleaning device (an example of the cleaning unit) 6Y that removes toner left on the surface of the photosensitive member 1Y after the first transfer.

The first transfer roller 5Y is disposed inside the intermediate transfer belt 20 at a position opposite the photosensitive member 1Y. Furthermore, bias power supplies (not illustrated) are connected to the first transfer rollers 5Y, 5M, 5C, and 5K to apply a first transfer bias thereto. A controller (not illustrated) controls the bias power supplies to change the transfer bias applied to the first transfer rollers.

Hereafter, the operation of forming a yellow image in the first unit 10Y will be described.

Before the operation, the charging roller 2Y charges the surface of the photosensitive member 1Y to a potential of −600 to −800 V.

The photosensitive member 1Y includes a conductive substrate (e.g., a substrate having a volume resistivity of $1\times10^{-6}$ Ωcm or less at 20° C.) and a photosensitive layer stacked thereon. The photosensitive layer, which normally has high resistivity (a resistivity similar to those of typical resins), has a property of changing its resistivity in a region irradiated with a laser beam 3Y. The laser beam 3Y is emitted from the exposure device 3 toward the charged surface of the photosensitive member 1Y based on yellow image data sent from a controller (not shown). The laser beam 3Y impinges on the photosensitive layer of the photosensitive member 1Y to form an electrostatic image corresponding to a yellow image pattern on the surface of the photosensitive member 1Y.

Electrostatic images are images formed on the surface of the photosensitive member 1Y by performing charging. Electrostatic images are negative latent images formed when electric charge dissipates from the surface of the photosensitive member 1Y due to decreased resistivity of the photosensitive layer in a region irradiated with the laser beam 3Y while remaining in a region not irradiated with the laser beam 3Y.

The electrostatic image formed on the photosensitive member 1Y is transported to a predetermined development position as the photosensitive member 1Y is rotated. The electrostatic image on the photosensitive member 1Y is made visible (i.e., developed) as a toner image at the development position by the developing device 4Y.

The developing device 4Y accommodates an electrostatic image developer including at least a yellow toner and a carrier. The yellow toner is triboelectrically charged by being stirred inside the developing device 4Y. The yellow toner is charged to the same polarity (i.e., negative polarity) as the surface of the photosensitive member 1Y and is carried by a developer roller (an example of the developer carrier). As the surface of the photosensitive member 1Y passes through the developing device 4Y, the yellow toner is electrostatically attracted to a latent image portion, from which electricity has been removed, on the surface of the photosensitive member 1Y to develop the latent image with the yellow toner. The photosensitive member 1Y on which the yellow toner image has been formed continues to rotate at a predetermined speed and conveys the toner image formed on the photosensitive member 1Y to a predetermined first transfer position.

When the yellow toner image on the photosensitive member 1Y is conveyed to the first transfer position, a first transfer bias is applied to the first transfer roller 5Y. An electrostatic force from the photosensitive member 1Y toward the first transfer roller 5Y is exerted on the toner image to transfer the toner image on the photosensitive member 1Y onto the intermediate transfer belt 20. The transfer bias applied herein has a polarity (+) opposite to the polarity (−) of the toner. For example, the transfer bias applied in the first unit 10Y is controlled to +10 μA by a controller (not illustrated).

The toner left on the photosensitive member 1Y is removed and collected by the photosensitive member cleaning device 6Y.

The first transfer biases applied to the first transfer rollers 5M, 5C, and 5K of the second to fourth units 10M, 10C, and 10K are also controlled in the same manner.

Thus, the intermediate transfer belt 20 on which the yellow toner image has been transferred by the first unit 10Y is sequentially transported through the second to fourth units 10M, 10C, and 10K, and toner images of different colors are transferred to the intermediate transfer belt 20 such that they are superimposed on top of each other.

After the toner images of the four colors are transferred to the intermediate transfer belt 20 by the first to fourth units 10Y, 10M, 10C, and 10K, the superimposed toner image is conveyed to a second transfer section. The second transfer section includes the intermediate transfer belt 20, the support roller 24 in contact with the inner surface of the intermediate transfer belt 20, and a second transfer roller (an example of the second transfer unit) 26 disposed on the image carrier side of the intermediate transfer belt 20. A recording paper (an example of the recording medium) P is fed into a gap between the second transfer roller 26 and the intermediate transfer belt 20 at a predetermined timing by a feed mechanism. A second transfer bias is then applied to the support roller 24. The second transfer bias applied herein has a polarity (−) that is the same as the polarity (−) of the toner. An electrostatic force from the intermediate transfer belt 20 toward the recording paper P is exerted on the toner image to transfer the toner image on the intermediate transfer belt 20 onto the recording paper P. The second transfer bias is determined and controlled depending on the resistance detected by a resistance detector (not illustrated) that detects the resistance of the second transfer section.

Subsequently, the recording paper P is fed to a nip of a pair of fixing rollers in the fixing device (an example of the fixing unit) 28. The toner image is fixed on the recording paper P, and thus a fixed image is formed.

An example of the recording paper P onto which the toner image is transferred is plain paper used in electrophotographic copiers, printers, and the like. Another example of the recording medium is an overhead projector (OHP) sheet.

To further improve the smoothness of the surface of the fixed image, the surface of the recording paper P may also be smooth. Examples of such recording paper P include coated paper, which is plain paper coated with resin or the like, and art paper for printing.

The recording paper P on which the color image has been fixed is conveyed toward an ejection port. Thus, a series of color image forming operations are completed.

Process Cartridge

A process cartridge according to this exemplary embodiment will be described.

The process cartridge according to this exemplary embodiment is a process cartridge that is detachably attachable to an image forming apparatus and includes a developing unit that develops, as a toner image, an electrostatic image formed on a surface of an image carrier with the developing device according to this exemplary embodiment.

The process cartridge according to this exemplary embodiment is not limited to the above configuration, and may include the developing device and optionally at least one selected from other units such as an image carrier, a charging unit, an electrostatic image forming unit, and a transferring unit.

Hereafter, an example of the process cartridge according to this exemplary embodiment will be described, but the process cartridge is not limited thereto. Only principal parts illustrated in the drawing are described, and the description of other parts is omitted.

Figure 5:
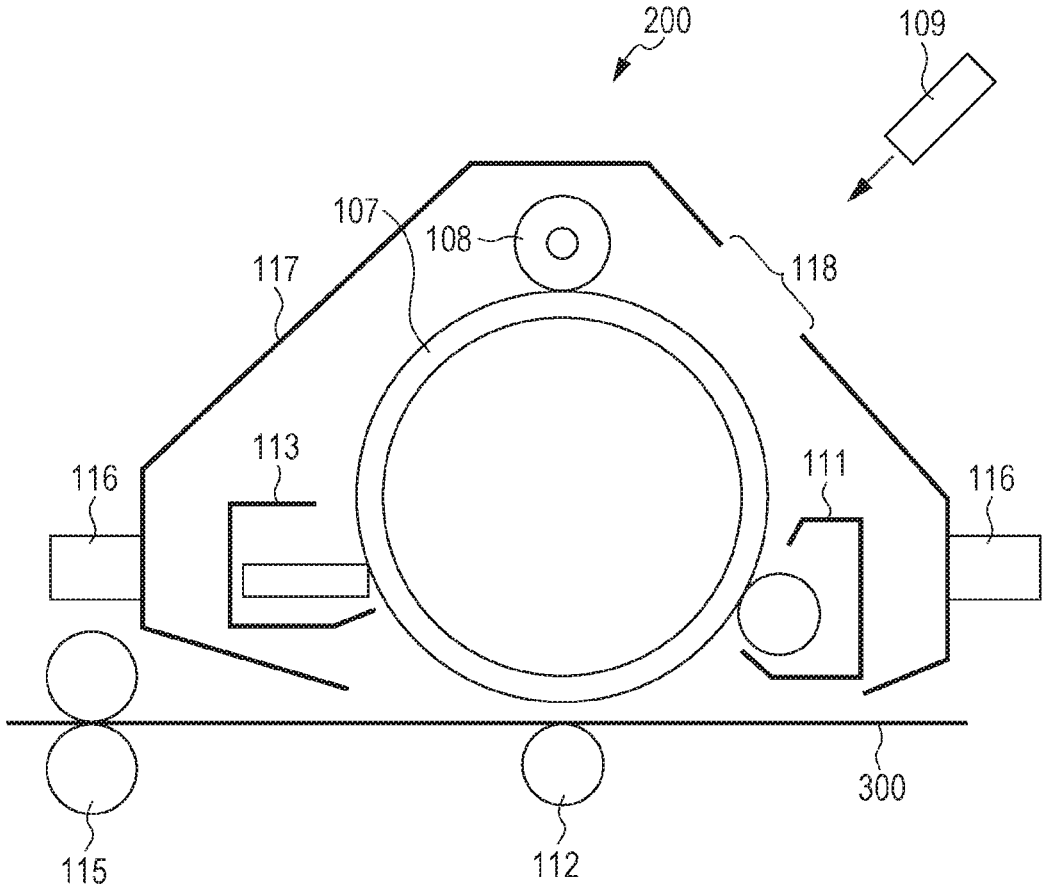
FIG. 5 schematically illustrates an example of a process cartridge according to this exemplary embodiment.

FIG. 5 schematically illustrates a process cartridge according to this exemplary embodiment.

A process cartridge 200 illustrated in FIG. 5 includes a photosensitive member (an example of the image carrier) 107 around which are arranged a charging roller (an example of the charging unit) 108, a developing device (an example of the developing unit) 111, and a photosensitive member cleaning device (an example of the cleaning unit) 113. The photosensitive member 107, the charging roller 108, the developing device 111, and the photosensitive member cleaning device 113 are assembled into a cartridge with a housing 117 having mounting rails 116 and an opening 118 for exposure.

FIG. 5 also illustrates an exposure device (an example of the electrostatic image forming unit) 109, a transfer device (an example of the transferring unit) 112, a fixing device (an example of the fixing unit) 115, and a recording paper (an example of the recording medium) 300.

EXAMPLES

Hereafter, the exemplary embodiments will be further specifically described based on Examples and Comparative Examples, but the exemplary embodiments are not limited to Examples below. Note that "part" and "%" mean "part by mass" and "% by mass" unless otherwise specified.

Example 1

Production of Developer 1

Production of Toner Particles C1

(1) Preparation of Binder Resin Particle Dispersion Liquid

A solution A is prepared by mixing 370 parts of styrene, 30 parts of n-butyl acrylate, 8 parts of acrylic acid, 24 parts of dodecanethiol, and 4 parts of carbon tetrabromide. A solution B is prepared by dissolving 6 parts of a nonionic surfactant (Nonipol 400 manufactured by Sanyo Chemical Industries, Ltd.) and 10 parts of an anionic surfactant (Neogen SC manufactured by DKS Co. Ltd.) in 550 parts of ion-exchanged water. A solution C is prepared by dissolving 4 parts of ammonium persulfate in 50 parts of ion-exchanged water. Then, the solution A and the solution B are inserted into a flask. The solution C is gradually added to the resulting mixture being gently stirred over 10 minutes to cause emulsion polymerization.

After the flask is purged with nitrogen, the material inside the flask is heated under stirring to 70° C. using an oil bath, and the emulsion polymerization is continuously caused to proceed for 5 hours. As a result, a binder resin particle dispersion liquid is obtained in which binder resin particles having a volume-average particle size of 150 nm, a glass transition temperature Tg of 58° C., and a weight-average molecular weight Mw of 11500 are dispersed in the solution. The binder resin particle dispersion liquid has a solid content of 40%.

(2) Preparation of Coloring Agent Dispersion Liquid

Sixty parts of a cyan pigment (manufactured by Dainichiseika Color & Chemicals Mfg. Co., Ltd., copper phthalocyanine C.I. Pigment Blue 15:3), 6 parts of a nonionic surfactant (Nonipol 400 manufactured by Sanyo Chemical Industries, Ltd.), and 240 parts of ion-exchanged water are mixed with each other. The resulting mixture is stirred with a homogenizer (ULTRA-TURRAX T5 manufactured by IKA) for 10 minutes and then subjected to dispersion treatment with an Ultimaizer to obtain a coloring agent dispersion liquid in which coloring agent (carbon black) particles having an average particle size of 250 nm are dispersed.

(3) Preparation of Release Agent Dispersion Liquid

One hundred parts of paraffin wax (HNP0190 manufactured by NIPPON SEIRO CO., LTD., melting point: 85° C.), 5 parts of a cationic surfactant (SANISOL B50 manufactured by Kao Corporation), and 240 parts of ion-exchanged water are dispersed in a round-bottom stainless steel flask using a homogenizer (ULTRA-TURRAX T50 manufactured by IKA) for 10 minutes. Then, the resulting product is dispersed using a pressure discharge homogenizer to prepare a release agent dispersion liquid in which release agent particles having an average particle size of 550 nm are dispersed.

(4) Production of Toner Particles C1

After 234 parts of the binder resin particle dispersion liquid, 30 parts of the coloring agent dispersion liquid, 40 parts of the release agent dispersion liquid, 1.0 part of polyaluminum hydroxide (Paho2S manufactured by ASADA CHEMICAL INDUSTRY CO., LTD.), and 600 parts of ion-exchanged water are mixed and dispersed in a round-bottom stainless steel flask using a homogenizer (ULTRA-TURRAX T50 manufactured by IKA), the resulting product is heated under stirring to 40° C. using a heating oil bath. The product is kept at 40° C. for 30 minutes. Consequently, the formation of aggregated particles having a volume-average particle size D50v of 3.5 μm is confirmed.

Subsequently, the temperature of the heating oil bath is increased to 56° C. and kept for 1 hour. At this moment, the volume-average particle size D50v is 4.3 μm. After 26 parts of the binder resin particle dispersion liquid is added to the dispersion liquid containing the aggregated particles, the temperature of the heating oil bath is decreased to 50° C. and kept for 30 minutes. Subsequently, 1 N sodium hydroxide is added to the dispersion liquid containing the aggregated particles to adjust the pH to 7.0. The stainless steel flask is then hermetically sealed, heated to 90° C. under stirring using a magnetic seal, and kept at 90° C. for 4 hours. The dispersion liquid containing the aggregated particles is cooled. Then, the aggregated particles (toner particles) are filtered, washed with ion-exchanged water four times, and freeze-dried to obtain black toner particles C1. The toner particles C1 have a volume-average particle size $D_T$ of 4.7 μm and an average circularity of 0.96.

Production of Developer 1

(1) Production of Carrier

First, 2 parts of a perfluorooctylethyl methacrylate/methyl methacrylate copolymer (component ratio: 15/85), 0.2 parts of carbon black (VXC72 manufactured by CABOT), and 14 parts of toluene are stirred in a sand mill for 10 minutes to prepare a dispersed coating liquid. The coating liquid and 100 parts of ferrite particles (average particle size: 35 μm) are then inserted into a vacuum degassing kneader. The pressure is reduced to 560 mmHg (74660 Pa) and mixing is performed under stirring at 60° C. for 30 minutes. Furthermore, the temperature is increased to 90° C. and the pressure is reduced to 40 mmHg (5330 Pa), and stirring and drying are performed for 30 minutes to obtain a carrier. The obtained carrier has a volume resistivity of $10^{11}$ Ω·cm at an applied electric field of 1000 V/cm.

(2) Production of Cyan (C Color) Toner

To 100 parts of the toner particles C1, 1.0 part of rutile titanium oxide (particle size: 20 nm, surface treatment with n-decyltrimethoxysilane), 2.0 parts of silica (particle size: 140 nm, surface treatment with hexamethyldisilazane (HMDS), particle production method: sol-gel method), and 0.07 parts of zinc stearate particles (Nissan Elector MZ-2, volume-average particle size $D_S$ (median diameter on a volume basis): 2.0 μm, manufactured by NOF CORPORATION) are added, and the resulting mixture is blended in a 5 L Henschel mixer at a peripheral speed of 30 m/s for 15 minutes. Then, coarse particles are removed using a sieve having an opening of 45 μm to obtain a cyan (C color) toner. The amount of zinc stearate particles added in the toner is 0.07% by mass.

(3) Production of Developer 1

Eight parts of the C color toner and 100 parts of the carrier are stirred using a V-blender at 40 rpm for 20 minutes. The resulting product is screened with a sieve having an opening of 212 μm to obtain a developer 1. Examples 2 and 3 and Comparative Examples 1 to 3

A developer is obtained in the same manner as in Example 1, except that the volume-average particle size of the toner particles is changed to that listed in Table 1, the zinc stearate particles are changed to those having a volume-average particle size $D_S$ listed in Table 1, and the amount of the zinc stearate particles added is changed to that listed in Table 1.

The details of the zinc stearate particles listed in Table 1 are as follows.

Volume-average particle size $D_S$ "2.0 μm"=Nissan Elector MZ-2, manufactured by NOF CORPORATION Volume-average particle size $D_S$ "3.0 μm"=zinc stearate FP, manufactured by NOF CORPORATION Volume-average particle size $D_S$ "5.5 μm"=zinc stearate FP, manufactured by NOF CORPORATION Evaluation A modified Docucentre-IV C5570 manufactured by Fuji Xerox Co., Ltd. is used as an image forming apparatus, and the developers obtained in Examples and Comparative Examples are supplied to the apparatus. The image forming apparatus is modified as follows. The developer carrier (developing roller), the supply conveyor (supply auger), and the mixing conveyor (admixing auger) in the developing device are located so as to satisfy the positional relationship in the gravity direction as illustrated in FIG. 1. The angle (θ1) formed between the developing roller and the supply auger is 60°, and the angle (θ2) formed between the supply auger and the admixing auger is 30°.

Image formation of 100 kPV (100,000 sheets) is performed with the image forming apparatus so that an image is formed only in a portion in the axial direction of the photosensitive member, and the following evaluation is performed.

Evaluation of Wear Step (Uneven Wear)

For the photosensitive member after the image formation of 10 kPV (10,000 sheets), the wear rate (nm/kcyc) is measured at intervals of 10 mm in the axial direction, and evaluation is performed on the basis of the following evaluation criteria. The axial direction wear difference refers to a difference between the maximum wear rate (nm/kcyc) and the minimum wear rate (nm/kcyc).

Evaluation Criteria

A: The axial direction wear difference is less than 3 nm/kcyc.

B: The axial direction wear difference is 3 nm/kcyc or more and less than 6 nm/kcyc.

C: The axial direction wear difference is 6 nm/kcyc or more.

Figure 6:
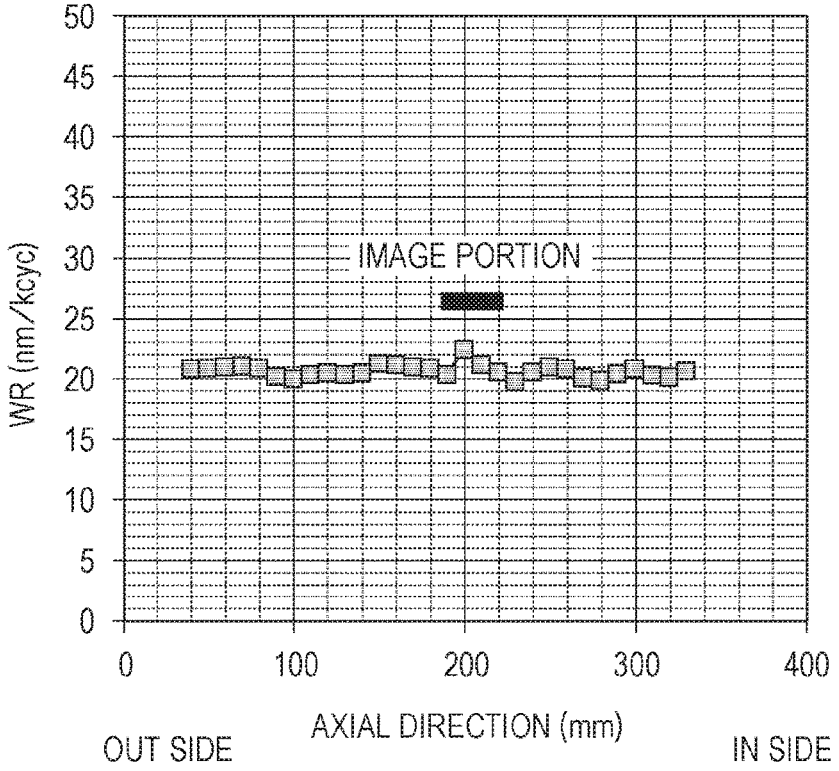
FIG. 6 is a graph illustrating a state of wear on a photosensitive member after image formation in Example 1.
Figure 7:
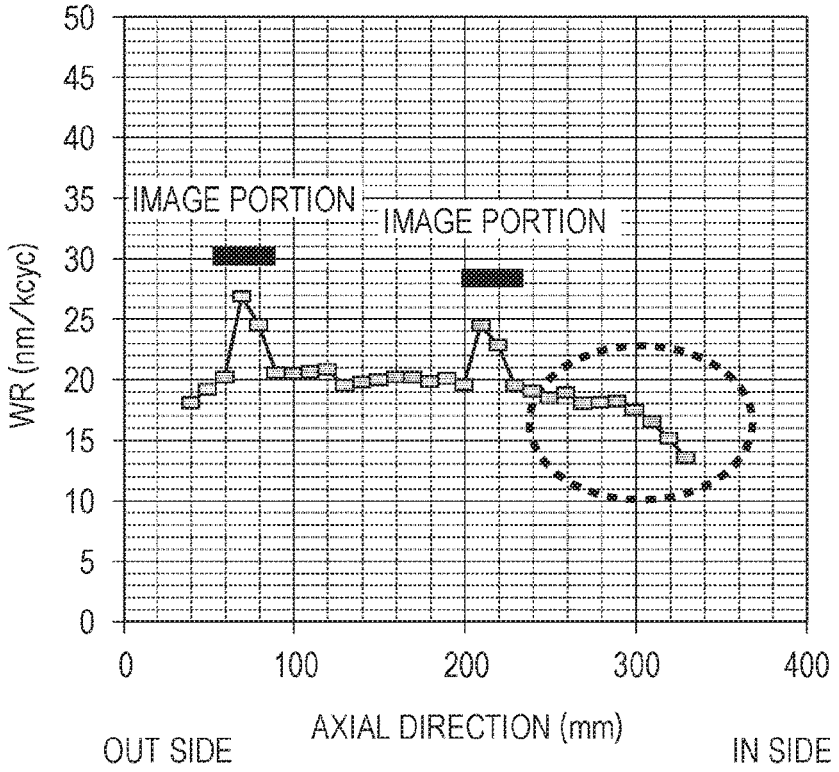
FIG. 7 is a graph illustrating a state of wear on a photosensitive member after image formation in Comparative Example 2.

In Example 1 and Comparative Example 2, the wear rate at each position in the axial direction of the photosensitive member is calculated as a wear rate per 1000 rotations (1 kcycle) of the photosensitive member, and the results are plotted on graphs. FIG. 6 illustrates the results of Example 1 and FIG. 7 illustrates the results of Comparative Example 2. The "IN side" on the graph corresponds to a side on which a passage is present through which the developer is moved from the admixing auger to the supply auger against gravity.

Evaluation of in-Plane Concentration Difference

After the image formation of 100 kPV (100,000 sheets), halftone images (30% and 50%) are further formed. For these images, the in-plane concentration difference (concentration unevenness) is evaluated as follows.

Evaluation Criteria

A: Concentration unevenness that poses a problem in terms of image quality does not occur (concentration unevenness is not observed through visual inspection).

B: Concentration unevenness slightly occurs (concentration unevenness is observed through visual inspection, but is negligible).

C: Concentration unevenness that poses a problem in terms of image quality occurs.

Evaluation of Uneven Distribution of Zinc Stearate

For the developing device after the image formation of 10 kPV (10,000 sheets), the occurrence of uneven distribution of the zinc stearate particles at the passage through which the developer is moved from the admixing auger to the supply auger is evaluated as follows. The amount (atm %) of Zn in the developer present around the supply auger is analyzed in the axial direction by X-ray photoelectron spectroscopy (XPS). The ratio A/B of the Zn amount A (atm %) at the passage through which the developer is moved from the admixing auger to the supply auger to the Zn amount B (atm %) at a portion other than the passage is determined. The uneven distribution is evaluated on the basis of the following criteria.

Evaluation Criteria

A: $1 \leq A/B \leq 1.3$

B: $1.3 < A/B \leq 2$

C: $A/B > 2$

Reference Examples 1 and 2

In Reference Examples, the angle (θ2) formed between the supply auger and the admixing auger in the image forming apparatus used for the evaluation test is changed to 0°.

A developer is obtained in the same manner as in Example 1, except that the volume-average particle size of the toner particles is changed to that listed in Table 1, the zinc stearate particles are changed to those having a volume-average particle size $D_S$ listed in Table 1, and the amount of the zinc stearate particles added is changed to that listed in Table 1.

Figure 8:
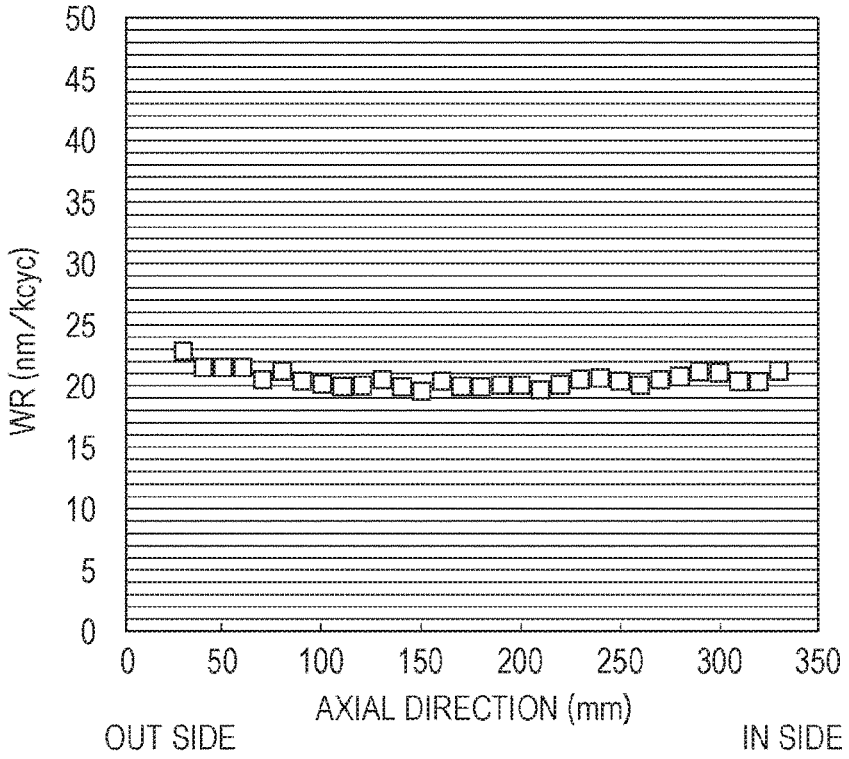
FIG. 8 is a graph illustrating a state of wear on a photosensitive member after image formation in Reference Example 1.
Figure 9:
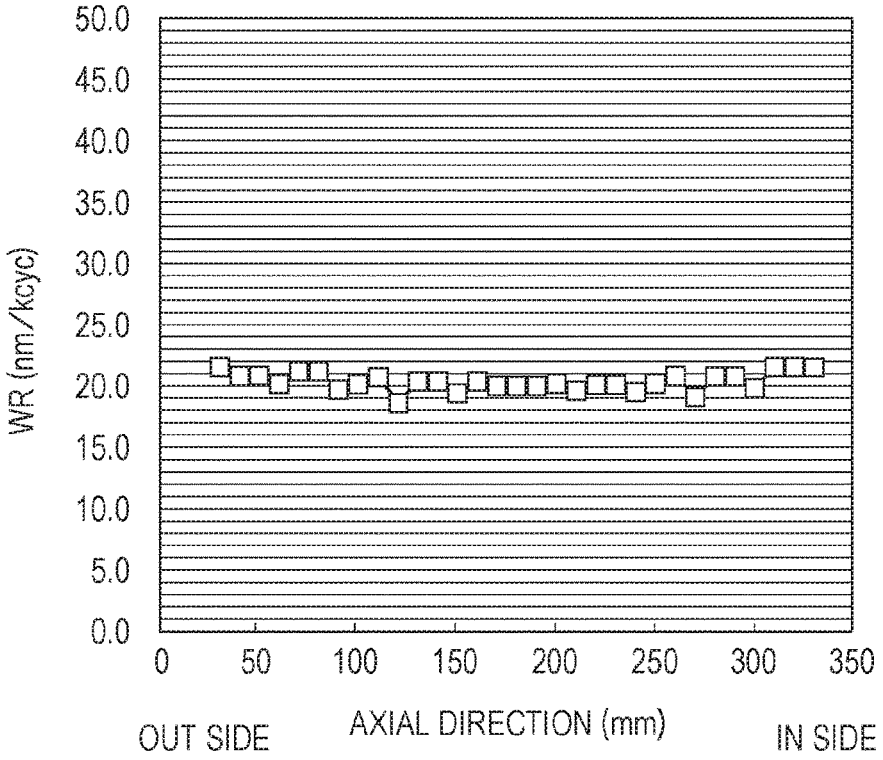
FIG. 9 is a graph illustrating a state of wear on a photosensitive member after image formation in Reference Example 2.

FIG. 8 and FIG. 9 are graphs obtained by plotting the results of the evaluation of wear step (uneven wear) in Reference Examples 1 and 2.

As shown in Table 1 below, in the case where the angle (θ2) formed between the supply auger and the admixing auger is 0°, even when the ratio ($D_T/D_S$) is 0.7 (Reference Example 1) or 1.1 (Reference Example 2), the uneven distribution of the zinc stearate particles does not occur and thus the uneven wear of the photosensitive member also does not occur.

TABLE 1

| | Toner particles | Zinc stearate particles | | | | | Evaluation | | |
|---|---|---|---|---|---|---|---|---|---|
| | Particle size [$D_T$] (μm) | Particle size [$D_S$] (μm) | Addition amount (mass %) | Aspect ratio | $D_T/D_S$ ratio | θ2 (degree) | Wear step | In-plane concentration difference | Uneven distribution of zinc stearate |
| Example 1 | 4.7 | 2 | 0.07 | 10 | 2.4 | 30 | A | A | A |
| Example 2 | 3.8 | 2 | 0.07 | 10 | 1.9 | 30 | A | A | A |
| Example 3 | 5.8 | 3 | 0.09 | 10 | 1.9 | 30 | A | A | A |
| Comparative Example 1 | 4.7 | 3 | 0.07 | 10 | 1.6 | 30 | B | B | B |
| Comparative Example 2 | 5.8 | 5.5 | 0.09 | 10 | 1.1 | 30 | C | C | C |
| Comparative Example 3 | 4.7 | 5.5 | 0.07 | 10 | 0.9 | 30 | C | C | C |
| Reference Example 1 | 3.8 | 5.5 | 0.14 | 10 | 0.7 | 0 | A | A | A |
| Reference Example 2 | 5.8 | 5.5 | 0.09 | 10 | 1.1 | 0 | A | A | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer container that accommodates an electrostatic image developer including toner containing a toner particle and a zinc stearate particle externally added to the toner particle, a ratio (DT/DS) of a volume-average particle size (DT) of the toner particle to a volume-average particle size (DS) of the zinc stearate particle being 1.9 or more, and the volume-average particle size (DS) of all zinc stearate particles in the toner are within the range of 1.0 μm to 6.0 μm, inclusive;

a developer carrier that has a surface on which the electrostatic image developer is carried and that supplies the toner to an image carrier;

a supply conveyor that supplies the electrostatic image developer to the surface of the developer carrier while conveying the electrostatic image developer in an axial direction of the developer carrier;

a mixing conveyor disposed on a lower side of the supply conveyor in a gravity direction, the mixing conveyor conveying the electrostatic image developer in the axial direction of the developer carrier while mixing the electrostatic image developer, the mixing conveyor conveying the electrostatic image developer in a direction opposite to a direction in which the supply conveyor conveys the electrostatic image developer; and a partition disposed between the supply conveyor and the mixing conveyor, wherein the electrostatic image developer is moved from the supply conveyor to the mixing conveyor through a first passage provided at one end portion of the partition, and the electrostatic image developer is moved from the mixing conveyor to the supply conveyor through a second passage provided at the other end portion of the partition.

2. The developing device according to claim 1, wherein the ratio (DT/DS) is less than 11.6.

3. The developing device according to claim 2, wherein the zinc stearate particle has a substantially thin-layer shape with an aspect ratio of 2 or more and 20 or less.

4. The developing device according to claim 1, wherein the zinc stearate particle has a substantially thin-layer shape with an aspect ratio of 2 or more and 20 or less.

5. A process cartridge detachably attachable to an image forming apparatus, the process cartridge comprising:

the developing device according to claim 1.

6. An image forming apparatus comprising:

an image carrier;

a charging unit configured to charge a surface of the image carrier;

an electrostatic image forming unit configured to form an electrostatic image on the charged surface of the image carrier;

a developing unit that includes the developing device according to claim 1 and that is configured to develop, as a toner image, the electrostatic image formed on the surface of the image carrier with the electrostatic image developer;

a transferring unit configured to transfer the toner image formed on the surface of the image carrier onto a surface of a recording medium; and a fixing unit configured to fix the toner image transferred onto the surface of the recording medium.

7. An image forming method comprising:

charging a surface of an image carrier;

forming an electrostatic image on the charged surface of the image carrier;

developing, as a toner image, the electrostatic image formed on the surface of the image carrier with the developing device according to claim 1;

transferring the toner image formed on the surface of the image carrier onto a surface of a recording medium; and fixing the toner image transferred onto the surface of the recording medium.

8. The developing device according to claim 1, wherein the volume-average particle size (DS) of the zinc stearate particle is within the range of 1.5 μm to 5.0 μm, inclusive.

9. The developing device according to claim 1, wherein the volume-average particle size (DS) of the zinc stearate particle is within the range of 2.0 μm to 4.0 μm, inclusive.

10. A developing device comprising:

a developer container that accommodates an electrostatic image developer including toner containing a toner particle and a zinc stearate particle externally added to the toner particle, a ratio (DT/DS) of a volume-average particle size (DT) of the toner particle to a volume-average particle size (DS) of the zinc stearate particle being 1.9 or more, and the volume-average particle size (DS) of all zinc stearate particles in the toner is less than 8.0 μm;

a developer carrier that has a surface on which the electrostatic image developer is carried and that supplies the toner to an image carrier;

a supply conveyor that supplies the electrostatic image developer to the surface of the developer carrier while conveying the electrostatic image developer in an axial direction of the developer carrier;

a mixing conveyor disposed on a lower side of the supply conveyor in a gravity direction, the mixing conveyor conveying the electrostatic image developer in the axial direction of the developer carrier while mixing the electrostatic image developer, the mixing conveyor conveying the electrostatic image developer in a direction opposite to a direction in which the supply conveyor conveys the electrostatic image developer; and a partition disposed between the supply conveyor and the mixing conveyor, wherein the electrostatic image developer is moved from the supply conveyor to the mixing conveyor through a first passage provided at one end portion of the partition, and the electrostatic image developer is moved from the mixing conveyor to the supply conveyor through a second passage provided at the other end portion of the partition.

* * * * *